United States Patent [19]

Montgomery et al.

[11] Patent Number: 4,564,141

[45] Date of Patent: Jan. 14, 1986

[54] APPARATUS AND METHOD FOR DOMESTIC HOT WATER CONTROL

[75] Inventors: Douglas J. Montgomery, Trumbull, Conn.; Leonard H. Goldstein, Hyde Park; Ernest Stumbo, Clinton Corners, both of N.Y.

[73] Assignee: Doleer Electronics, Inc., Clinton Corners, N.Y.

[21] Appl. No.: 668,286

[22] Filed: Nov. 5, 1984

[51] Int. Cl.[4] ..... F23N 5/02

[52] U.S. Cl. ..... 236/20 R; 126/362; 236/46 R; 236/14

[58] Field of Search ..... 237/8 R, 19; 126/362; 236/14, 24, 46 R, 20 R

[56] References Cited

U.S. PATENT DOCUMENTS

| | | | |
|---|---|---|---|
| 4,182,489 | 1/1980 | Lessieur | 237/8 R |
| 4,381,075 | 4/1983 | Cargill et al. | 237/8 R |
| 4,483,479 | 11/1984 | Snell | 237/19 |

*Primary Examiner*—Henry Bennett

*Attorney, Agent, or Firm*—Costas, Montgomery & Dorman

[57] ABSTRACT

A domestic hot water heating system which disables the normal aquastat during set-back periods where the temperature of the water source is sensed at the output manifold and the temperature of the water also is sensed a predetermined distance along the manifold to determine a demand or lack of demand for hot water. The system will enable the aquastat during a set-back period when demand is made and disable the aquastat when there is no longer a demand.

22 Claims, 3 Drawing Figures

APPARATUS AND METHOD FOR DOMESTIC HOT WATER CONTROL

FIELD OF THE INVENTION

This invention relates to hot water heating systems, and more particularly, relates to heating controls for domestic hot water systems and a method of operating a domestic hot water system during temperature set-back periods.

BACKGROUND OF THE INVENTION

In most domestic hot water heating systems, an oil or gas fired burner maintains a water supply between predetermined temperature limits. This supply may be either a reserve tank or a coil in the furnace or boiler. For example, a typical domestic hot water heating system will turn on the burner when the temperature of the reserve water decreases to a predetermined temperature, and will turn off the burner when the temperature of the reserve water increases to another predetermined value. The two temperature limits are set in a controller generally known as an aquastat.

This operation serves to maintain a domestic hot water reserve within given temperature limits even though at many hours of the day there is no demand for domestic hot water. Presently known set-back controls for water heaters are based on predetermined hours of the day where statistics tend to show there is less demand for domestic hot water. However, during the set-back periods, there may be a time when there is a demand for hot water which cannot be supplied and the user must wait for expiration of the set-back period.

Accordingly, the present invention provides a new and improved control system which almost immediately senses a demand for domestic hot water and will, in the set-back mode, allow almost immediate burner operation to satisfy demand, even though the reserve water temperature may not be within the limits set on the aquastat.

SUMMARY OF THE INVENTION

The invention is utilized in conjunction with a domestic hot water heating system in which a so-called aquastat controls or regulates upper and lower limits of hot water temperature. In such systems, the hot water temperature is normally maintained between upper and lower limits regardless of the degree of usage of the water. Where set-back controls are utilized to decrease the upper and lower temperature limits during predetermined times of the day, a demand for hot water may not be satisfied. In the present invention, the temperature of the hot water manifold is sensed closely adjacent the source by a first sensor and a predetermined distance therefrom by a second sensor. The sensor adjacent the source will always signal a higher temperature when the boiler is not turned off. By comparing the differences in the temperatures sensed at the two positions, logical decisions may be made as to operation of the aquastat. If during a set-back period, the temperature sensed adjacent the source by the first sensor is a predetermined amount higher than the temperature sensed by the second sensor, it is known that there is no demand for hot water. However, if the temperature differential decreases, the system recognizes a demand for hot water and causes the aquastat to fire the boiler and bring the water up to a given temperature range. After such demand is satisfied, the system detects when there is a predetermined difference in water temperature between the two sensors for a predetermined time and permits the aquastat to go back to the set-back mode.

It will be understood that when there is no demand for hot water, the temperature sensed by the second sensor will, after a while, approach ambient temperature while the temperature sensed by the first sensor is near the source temperature. This, of course, indicates that there is no demand for hot water. However, when the temperature sensed by the second sensor approaches that sensed by the first sensor, this indicates that the water from the source is flowing and hence, a demand for hot water is present.

The system may also measure the rate of change of sensed temperature and enable the aquastat in response thereto.

An object of this invention is to provide a new and improved control for a domestic hot water system in which the aquastat is controlled in response to demand for hot water.

Another object of this invention is to provide a new and improved method of operating a domestic hot water system during temperature set-back periods.

Another object of this invention is to provide a new and improved control for a domestic hot water system in which the temperature of the water of the source is sensed and the temperature of the water at the manifold a short distance from the source is sensed and logical decisions regarding the operations of the aquastat is made in response to a comparison of the sensed temperatures.

A further object of the invention is to provide a new and improved set-back mode of operation for a domestic hot water heating system.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF THE PREFERRED EMBODIMENT OF THE INVENTION

Figures 1, 2:
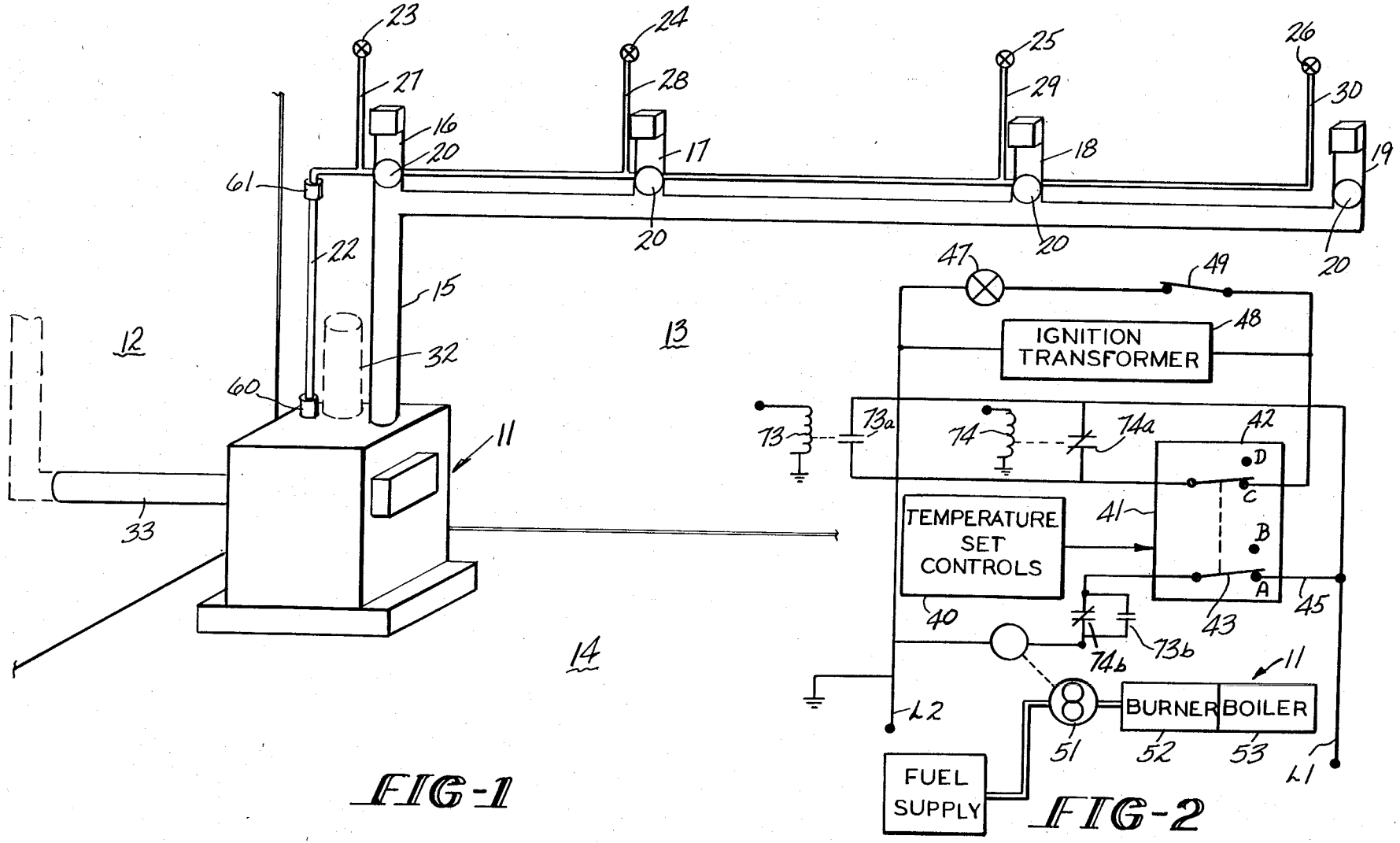
FIG. 1 is a schematic diagram, partly in perspective, which exemplifies a heating system including a domestic hot water system.
FIG. 2 is a schematic diagram of a furnace control system modified in accordance with the invention.

FIG. 1 exemplifies a furnace 11 situated in a room partially defined by walls 12 and 13, and a floor 14. The furnace is of conventional design and as shown, provides hot air to a plurality of different zones via an air duct 15. The zones are schematically designated at 16, 17, 18, and 19, and each zone may include an individual air vent control 20. Furnace 11 also provides hot water to a plurality of stations. A hot water manifold 22 supplies hot water to a plurality of domestic hot water taps 23, 24, 25, 26, via individual supply lines 27, 28, 29, and 30, respectively. The furnace may also include a domestic hot water reserve connected to manifold 22 by means within furnace 11 (not shown), represented by the reference numeral 32. The furnace further includes a conventional aquastat for controlling the operation of the domestic hot water portion of the furnace and the temperature of the domestic hot water. The furnace 11 further includes a conventional burner and controls therefor (not shown). The water source may either be the reservoir 32 or a coil in the furnace. Both arrangements are referred to as the water source. The exhaust from furnace 11 is conveyed through a conduit 33 extending through wall 12.

Referring now to FIG. 2, there is shown a conventional aquastat control for the domestic hot water portion of an oil fired furnace. This circuit 40 is connected between AC lines L1 and L2.

A water thermostat 41 includes a double pole, double throw switch having a ganged pair of contact arms 42 and 43. Under normal operation, when the temperature of the water in the reservoir 32 has fallen to a value sufficiently low to call for heating of the water, contact arms 42 and 43 both swing into their cold position, which is the indicated position. In this cold position of the water thermostat, an oil pump motor 44 is energized by connection to lines L1 and L2. Motor 44 runs to provide oil pressure in a supply line to the burner, regardless of whether or not the furnace controls are calling for operation of the furnace. However, if the furnace controls do also happen to call for operation of the oil burner, then the motor 44 is running as required. The circuit for energizing the motor 44 when the water thermostat 41 is in the cold position is traced from line L1 through a connection 45 and a contact A, engaged by the arm 43.

Circuit 40 includes the usual high and low temperature set controls 45 for the thermostat switch 41. Circuit 40 further includes the usual solenoid oil valve 47, an ignition transformer 48, an OFF-ON switch 49, and the usual furnace controls (not shown) for zone heating (not shown).

Thermostatic switch 41 is shown in its position for heating water. Circuits are closed through oil pump motor 44, solenoid valve 47 and ignition transformer 48, and fuel is supplied from a fuel supply 50 through pump 51 to a burner 52 which will heat water in boiler 53 or a coil. The burner 52 and boiler 53 are part of furnace 11. Water will be heated until the high temperature limit is reached. Then switch arms 42 and 43 switch to contacts D and B respectively, opening the circuits to oil pump motor 44, oil solenoid valve 47 and ignition transformer 48. There will be no further heating of the water until the water temperature falls to the low temperature limit. Under the normal mode of operation, contacts 74*a* and 74*b* are closed. However, in the time controlled set-back mode, contacts 74*a* and 74*b* are open and the system is disabled unless contacts 73*a* and 73*b* are closed.

In accordance with the invention, a demand for hot water is rapidly sensed when in the set-back mode and contacts 73*a* and 73*b* are closed to permit rapid heating of water.

Reference is again made to FIG. 1, two temperature sensing elements 60 and 61 are positioned on hot water manifold. The elements 60 and 61 are temperature responsive resistors known as thermistors. Thermistor 60 is positioned closely adjacent the reservoir 32 or source and is responsive to the temperature of the water therein. Thermistor 61 is spaced a predetermined distance from thermistor 60. As hereinafter explained, if the temperature differential between the thermistors reaches a predetermined value, contacts 73*a* and 73*b* are closed, permitting burner operation and heating of water.

Figure 3:
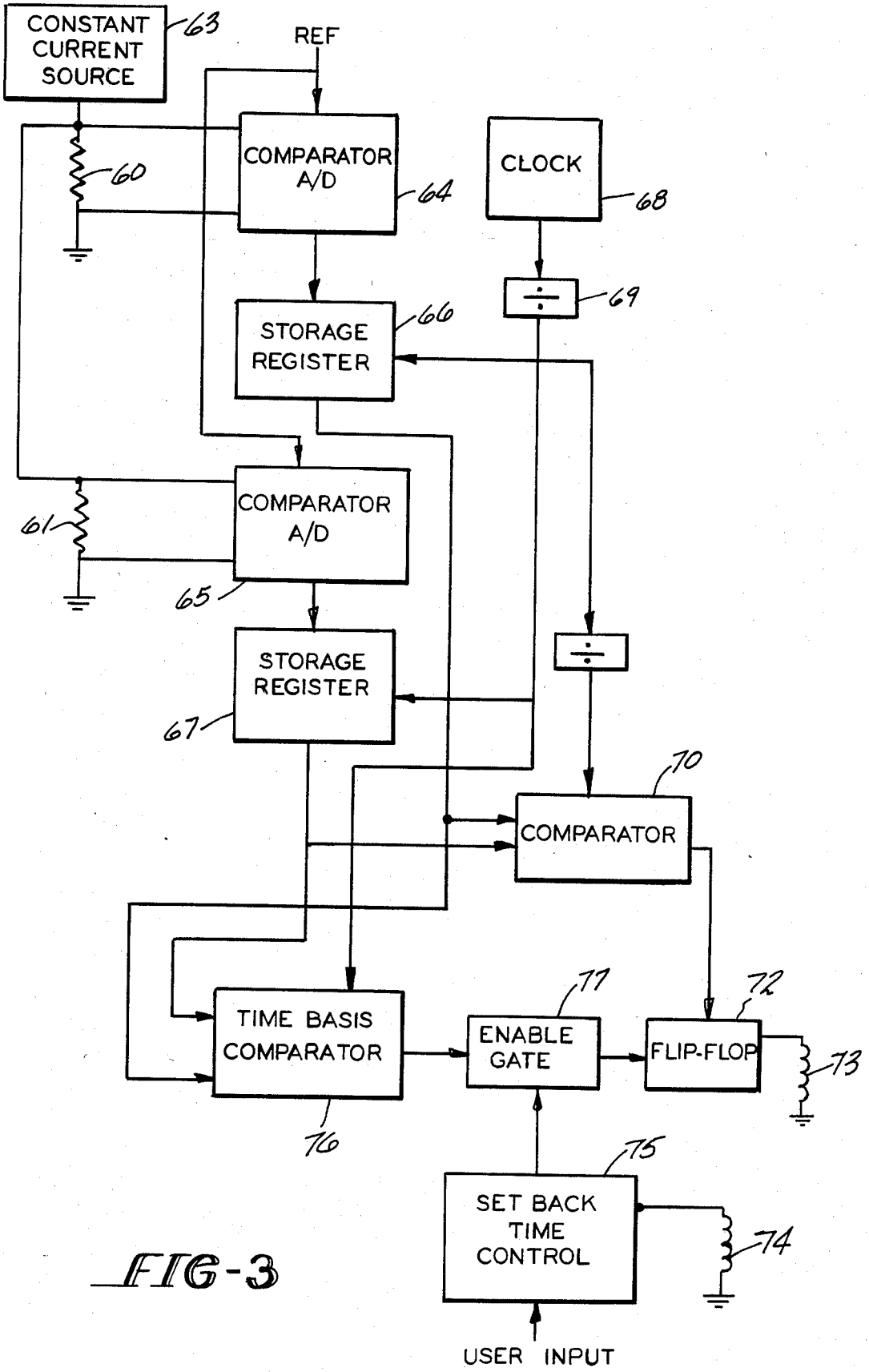
FIG. 3 is a block diagram of a logic system which may be utilized in accordance with the invention.

Reference is now made to FIG. 3 which is a logical block diagram of the system embodying the invention. The system of FIG. 3 is preferably established in a Motorola MC 6802 microprocessor.

Each of thermistors 60 and 61 is connected to a constant current source 63. Since the resistance of each will vary with temperature, the voltage thereacross will be proportional to the temperature of the water at the point of positioning on manifold 32.

The voltage across each thermistor 60 and 61 is compared with a reference signal in a comparator and analog to digital converter 64 and 65, respectively. Each of comparators will supply a pulse train having a frequency proportional to the sensed temperature. The output of comparator 64 is applied to a storage register 66 and the output of comparator 65 is applied to a storage register 67. Both registers include a pulse counter.

A clock 68 applies timing pulses to a divider 69 which polls the counters and registers at predetermined intervals of time, for example, every one-tenth of a second. When the counters are polled, the contents are cleared and placed in storage. The numerical content of registers 66 and 67, which is indicative of the temperatures sensed by thermistors 60 and 61, respectively, is compared in a comparator 70. Comparator 70 also receives a timing signal from a further divider 71. If comparator 71 detects a predetermined numerical difference, representing a predetermined difference in temperatures sensed by thermistors 60 and 61, for a predetermined time, it will apply a turn-off signal which will reset a flip-flop 72. When flip-flop 72 is reset, it will deenergize a relay 73, which will open its contact 73*a* (FIG. 2).

Assuming that contacts 74*a* and 74*b* of relay 74 are open, the aquastat will then cease heating the water. Relay 74 is energized and opens its contacts 74*a* and 74*b* during the times the system is in a set-back mode. The user sets a set-back time controller 75. Controller 75 energizes relay 74 during the set-back periods. Relay 74 then opens its normally closed contacts 74*a* and 74*b* to disable the aquastat. The aquastat then will not cause the burner to be fired unless relay 73 is energized to close contacts 73*a* and 73*b*.

The parameters sensed by comparator 70 may be a twenty degree temperature difference for a period of ten minutes. This would indicate no demand for hot water.

A time basis comparator 76 also compares the numerical values in storage registers 66 and 67, on a periodic basis. Various data in numerical form is stored in comparator 76, such as low limit set-back temperature, high limit aquastat temperature, differential temperature between thermistors or any other data required for comparison purposes. If the temperature sensed by thermistor falls to the low set-back limit, the comparison of numerical signal from storage register 66 with the low limit set-back number in comparator 76 will cause comparator 76 to provide a set signal to flip-flop 72. Thereafter, if there is no demand for hot water for a predetermined time after the water is heated, and the temperature differential sensed by thermistors 60 and 61 reaches a predetermined differential for said predetermined time, comparator 70 will reset flip-flop 72 and deenergize relay 73.

If comparator 76 furnishes an output signal, and a gate 77 is enabled by an output from set-back time controller 75, flip-flop 72 is set and relay 73 is energized, closing its contacts 73*a* and 73*b* (FIG. 2) to cause the aquastat to fire burner 52.

A rising predetermined change in temperature sensed by thermistor 60 in a predetermined time is also sensed by time basis comparator 76, which will then supply a set signal to flip-flop 72. If comparator 76 senses less than a predetermined differential between thermistors 60 and 61, this indicates that water is flowing, and as thermistor 61 approaches the temperature at the source, comparator 76 will then set flip-flop 72 and cause relay 73 to be energized. Such change indicates water is flowing from the source past thermistor 61 and hence there is a demand for hot water.

A slow change or steady reading in the temperature sensed by thermistor 61 with the temperature sensed by thermistor 60 being less than a predetermined low value will also cause comparator 76 to provide an output signal, thus causing aquastat 40 to become operative.

The set-back temperature limits are user definable and may, for example, be fifty and one hundred ten degrees Fahrenheit. A normal aquastat setting may be one hundred ten to one hundred eighty degrees Fahrenheit.

The invention permits the temperature of domestic hot water to be kept at much lower average temperature over a twenty-four hour period and thus requires substantially less fuel. However, upon demand during a set-back period, the water is rapidly brought up to the normal temperature range.

The function of the comparators 70 and 76 may be combined in one comparator network if desired. In this case, combined comparators would provide both turn-on and turn-off signals to flip-flop 72.

The invention may be utilized with any type of furnace exclusive of the space heating function of the furnace, or with a free standing hot water heater.

It may thus be seen that the objects of the invention set forth, as well as those made apparent from the foregoing description, are efficiently attained. While preferred embodiments of the invention have been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. In a domestic hot water system which comprises a means providing a source of hot water, an aquastat for controlling the heating of hot water at said source between predetermined temperature limits, and a manifold leading from said source to one or more user stations;

means for disabling said aquastat during predetermined intervals of time, a first temperature sensing means closely positioned to said source on said manifold, a second temperature sensing means positioned on said manifold and spaced from said first sensing means, away from said source, comparison means responsive to said first and second sensing means for comparing the temperatures sensed, means responsive to said comparison means sensing a predetermined temperature difference for enabling said aquastat to heat the water at said source during said predetermined intervals of time.

2. A method of operating a domestic hot water system which comprises a means providing a source of hot water, an aquastat for controlling the heating of hot water at said source between predetermined temperature limits, and a manifold leading from said source to one or more user stations, comprising the steps of disabling said aquastat during predetermined intervals of time, providing a first temperature sensing means closely positioned to said source on said manifold, providing a second temperature sensing means positioned on said manifold and spaced from said first sensing means, away from said source, comparing the temperatures sensed by said first and second sensing means, and in response to said comparison sensing a predetermined temperature difference, enabling said aquastat to heat the water at said source during said predetermined intervals of time.

3. A method of operating a domestic hot water system which comprises a means of providing a source of hot water, an aquastat for controlling the heating of said water between predetermined temperature limits, and a manifold leading from said source to one or more user stations, comprising the steps of disabling said aquastat during predetermined intervals of time, sensing the temperature of the water at said source, providing a temperature sensing means positioned on said manifold and spaced away from said source but prior to said one or more user stations, then comparing the temperature sensed at said source and by said temperature sensing means, and in response to said comparison indicating a predetermined temperature difference, enabling said aquastat to heat the water at said source during said predetermined intervals of time.

4. The system of claim 1 where said each of said temperature sensing means are thermistors.

5. The system of claim 1 where said comparison means recognizes a rapid change in the temperature sensed by said sensing means as a demand for hot water and enables said aquastat.

6. The system of claim 5 where said comparison means recognizes a predetermined difference in temperatures sensed by said first and second sensing means for a predetermined period of time and disables said aquastat.

7. The system of claim 1 wherein said comparator is responsive to the temperature sensed by said first sensing means reaching a predetermined lower value for enabling said aquastat.

8. The system of claim 7 where said comparison means recognizes a predetermined difference in temperatures sensed by said first and second sensing means for a predetermined period of time and disables said aquastat.

9. The method of claim 2 further including the step of recognizing a rapid change in the temperature sensed by said second sensing means as a demand for hot water and enabling said aquastat in response thereto.

10. The method of claim 2 wherein said step of comparing includes recognizing a predetermined difference in temperatures sensed by said first and second sensing means for a predetermined period of time and disabling said aquastat in response thereto.

11. The method of claim 2 including the further step of detecting from said first sensing means when the temperature sensed reaches a predetermined lower value and enabling said aquastat.

12. The system of claim 1 where said second temperature sensing means is positioned on said manifold prior to any supply lines leading from said manifold.

13. In a domestic hot water system which comprises a means providing a source of hot water, an aquastat for controlling the heating of hot water at said source between predetermined temperature limits, and a manifold leading from said source to one or more user stations;

means for disabling said aquastat during predetermined intervals of time, a first temperature sensing means for sensing the temperature of water at said source, a second temperature sensing means positioned on said manifold and spaced away from said source, comparison means responsive to said first and second sensing means for comparing the temperatures sensed, means responsive to said comparison means sensing a predetermined temperature difference for enabling said aquastat to heat the water at said source during said predetermined intervals of time.

14. The system of claim 13 where said comparison means recognizes a rapid change in the temperature sensed by said sensing means as a demand for hot water and enables said aquastat.

15. The system of claim 13 where said comparison recognizes a predetermined difference in temperatures sensed by said first and second sensing means for a predetermined period of time and disables said aquastat.

16. The system of claim 13 wherein said comparator is responsive to the temperature sensed by said first sensing means reaching a predetermined lower value for enabling said aquastat.

17. The system of claim 16 where said comparison means recognizes a predetermined difference in temperatures sensed by said first and second sensing means for a predetermined period of time and disables said aquastat.

18. The method of claim 3 further including the step of recognizing a rapid change in the temperature sensed by said second sensing means as a demand for hot water and enabling said aquastat in response thereto.

19. The method of claim 3 wherein said step of comparing includes recognizing a predetermined difference in temperatures sensed by said first and second sensing means for a predetermined period of time and disabling said aquastat in response thereto.

20. The method of claim 3 including the further step of detecting from said first sensing means when the temperature sensed reaches a predetermined lower value and enabling said aquastat.

21. The method of claim 20 wherein said step of comparing includes recognizing a predetermined difference in temperatures sensed by said first and second sensing means for a predetermined interval of time and disabling said aquastat in response thereto.

22. The method of claim 11 wherein said step of comparing includes recognizing a predetermined difference in temperatures sensed by said first and second sensing means for a predetermined interval of time and disabling said aquastat in response thereto.

* * * * *